United States Patent [19]

Brown

[11] 4,059,261

[45] Nov. 22, 1977

[54] MACHINE AND METHOD FOR SUCCESSIVELY FEEDING STACKED BLANKS

[76] Inventor: Robert L. Brown, 4055 Stoneview Circle, Stone Mountain, Ga. 30083

[21] Appl. No.: 694,723

[22] Filed: June 10, 1976

[51] Int. Cl.[2] ..... B65H 3/44; B65H 5/16; B65H 9/06

[52] U.S. Cl. ..... 271/9; 271/12; 271/245; 271/269

[58] Field of Search ..... 271/9, 12, 271, 245, 271/246, 233, 247, 269; 198/421; 270/58

[56] References Cited

U.S. PATENT DOCUMENTS

| | | | |
|---|---|---|---|
| 1,024,186 | 4/1912 | Dick | 271/246 |
| 1,195,231 | 8/1916 | Jones | 271/245 |
| 2,192,610 | 3/1940 | Keen et al. | 271/247 |
| 2,362,134 | 11/1944 | Honig | 270/58 |
| 2,623,746 | 12/1952 | Gegenheimer et al. | 271/271 |
| 2,897,950 | 8/1959 | Reed | 198/421 |
| 3,334,891 | 8/1967 | Clausen et al. | 271/9 X |

*Primary Examiner*—Bruce H. Stoner, Jr.
*Attorney, Agent, or Firm*—Robert B. Kennedy

[57] ABSTRACT

A machine for successively feeding stacked blanks comprising a conveyor mounted for movement along a conveyor path passing through a receiving station where blanks may be deposited thereon, and a plurality of chutes mounted successively above the conveyor path at the receiving station with each chute positioned in spaced relation with the conveyor. A machine for extracting blanks from stacks and for depositing them upon the chutes is located at the receiving station. The feed machine also has a mechanism for simultaneously holding blanks deposited upon the chutes and for simultaneously releasing them thereby to enable them to be simultaneously placed upon the conveyor and successively conveyed from the receiving station.

1 Claim, 9 Drawing Figures

Fig 6
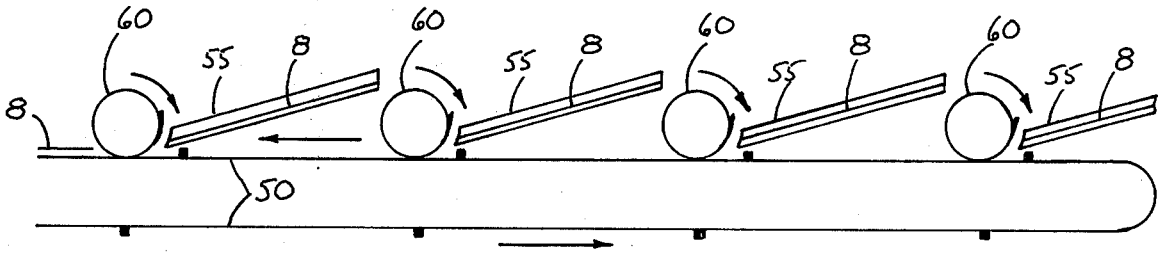
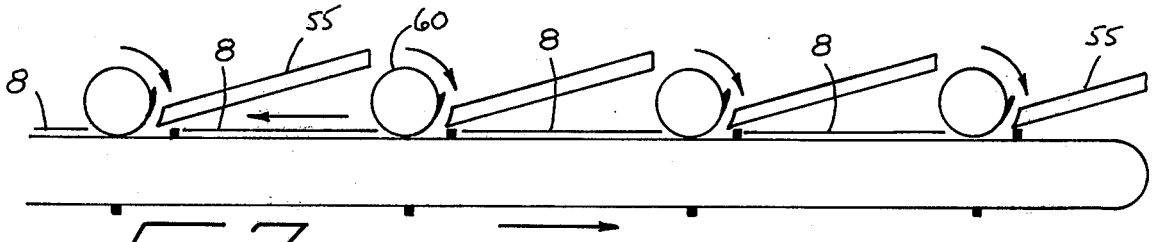
Fig 7
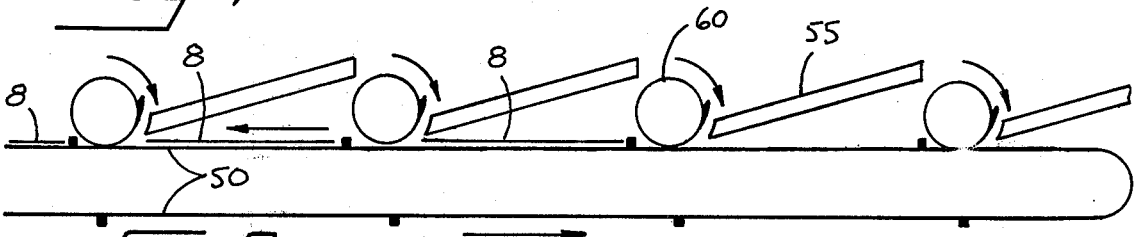
Fig 8
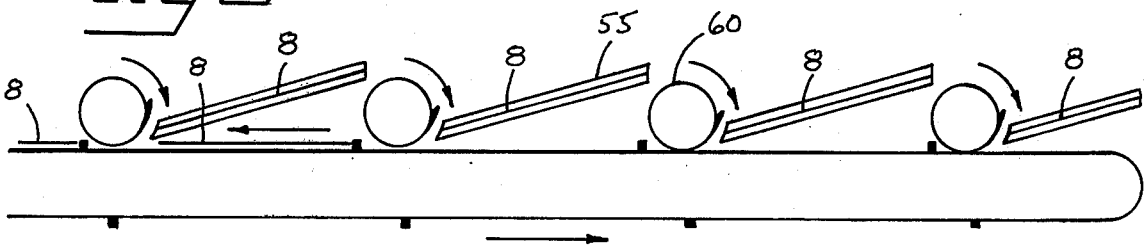
Fig 9

MACHINE AND METHOD FOR SUCCESSIVELY FEEDING STACKED BLANKS

BACKGROUND OF THE INVENTION

This invention relates to machines and methods for successively feeding stacked blanks.

Today there exists many industrial machines and processes which require successive feedings of blanks and sheet material. For example, box and carton erecting and packaging machines typically require a continuous supply of cardboard blanks to be fed thereto for box erection and packaging. Similarly, there exists many machines for forming metallic articles from flat blanks which similarly require a continuous supply of blanks fed thereto.

For most modern day machines and process lines, a manual, consecutive feeding of blanks is entirely too slow to accommodate the available speed of the machines and lines. To enhance the speed of supply the blanks have been piled one upon the other in stacks from which they are automatically extracted one at a time for feeding to the machine. As exemplified by that machine disclosed in U.S. Pat. No. 907,944 these blank feeding machines have previously comprised suction cups adapted to engage and lift the outermost blank from a blank stack and then position it upon a conveyor for transportation to an adjacent machine which performs operations thereon. More recently, in an effort to increase further speed of operations, other machines, such as that disclosed in U.S. Pat. No. 3,016,240, have been developed having gates effective in continuously moving in an advanced direction the blanks from their stacks to conveyors and into engagement with feed rollers mounted adjacent thereto.

Though the prior art automatic feeding machines have provided a decisive advantage over manual operations in successively feeding blanks and sheet materials, certain problems have nevertheless persisted. For example, advances in the machines to which the blanks are fed are continually creating demands for greater and greater speeds of blank injections. Such increases in speeds have been made only with a lessening in reliability. Recent attempts to increase speeds have thus been accomplished only at a sacrifice in the precision of spacings made between adjacent blanks upon the conveyor belts transporting them from their storage stacks to the operative machine. All too often actual jamming has occurred as has simultaneous doubling and even occasional triplings of blank removals and feedings. This has particularly been a troublesome point with the very recent development of machines having feed rollers which operate adjacent inclined hoppers or chutes in which stacks of blanks are stored at an incline and which extract them directly from the hopper one at a time.

Accordingly, it is a general object of the present invention to provide improved machines and methods for successively feeding stacked blanks and sheet materials.

More specifically, it is an object of the present invention to provide machines and methods for successively feeding stacked blanks with greater speed and precision of blank spacings.

Another object of the invention is to provide machines and methods of the type described having improved reliability.

Yet another object of the invention is to provide machines and methods of the type described of relatively simple and economic construction and which are adapted for use with existing devices for extracting blanks from stacks.

SUMMARY OF THE INVENTION

In one form of the invention a machine is provided for successively feeding stacked blanks comprising a conveyor mounted for movement along a conveyor path passing through a receiving station where blanks may be deposited thereon. A plurality of chutes is mounted successively above the conveyor path at the receiving station with each chute positioned in space relation with the conveyor. Means are provided for extracting blanks from the stacks and for depositing them upon the chutes. Means are also provided for holding blanks deposited upon the chutes and for simultaneously releasing them thereby enabling the blanks to be simultaneously placed upon the conveyor and successively conveyed from the receiving station.

In another form of the invention a machine is provided for successively feeding blanks from stacks. The machine comprises a conveyor and means for moving the conveyor through a receiving station. A set of chutes is consecutively mounted above the conveyor at the receiving station with each chute having a lower end positioned adjacent the conveyor thereby defining a gap therebetween through which blanks deposited on the conveyor from others of the chutes may pass. Means are also provided for simultaneously releasing blanks from the chutes and onto the conveyor in timed relation with the passage of the conveyor through the receiving station.

In yet another form of the invention a method is provided for successively feeding stacked blanks comprising the steps of positioning a series of blanks stacks along a conveyor, moving the conveyor past the series of stacks, extracting a blank from each of the stacks and positioning the extracted blanks at holding positions upon a series of chutes serially mounted above the moving conveyor, and simultaneously releasing the blanks from their holding positions and simultaneously depositing them serially upon the moving conveyor.

BRIEF DESCRIPTION OF THE DRAWING

FIGS. 6–9 are schematic views illustrating four sequences of blank positions during operation of the machine shown in FIGS. 2–5.

DESCRIPTION OF THE PREFERRED EMBODIMENT

Figure 1:
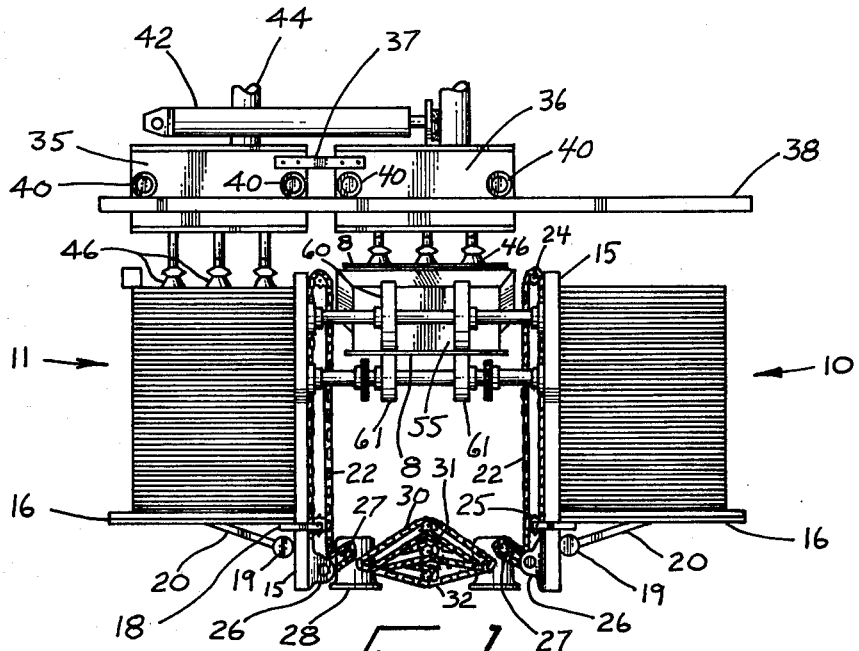
FIG. 1 is a front view, in elevation, of a machine for extracting blanks one at a time from a pair of blank stacks which may be used in conjunction with machines and methods of the present invention.

Referring now in more detail to the drawing, there is shown in FIG. 1 a machine for extracting blanks 8 one by one from a pair of blanks stacks 10 and 11. The machine comprises a side frame 15 to which a pair of platforms 16 are slideably mounted by lift collars 18 and guide wheels 19 rotatably held thereto by struts 20. The lift platforms 16 are adapted to be slowly raised during operation so as successively to present a blank at the top of each stack at approximately the same elevation. The lifting mechanism includes a pair of endless chains 22 engaged with upper sprockets 24 and lower sprockets 25 and which pass through pillow blocks 26 and to drive sprockets 27 protruding from reduction gear boxes 28. The chains 22 are driven through the reduction gear box by one of three chains 30, 31, and 32. Two of these chains are for raising platforms 16 at diverse, relatively slow speeds while the other is for rapidly lowering the platforms upon stack depletion to receive new stacks of blanks.

With continued reference to FIG. 1 the extracting machine is further seen to include a pair of carriages 35 and 36 coupled together by connection rods 37 which carriages are movably mounted atop a pair of rails 38 by rollers 40. The carriages are adapted to be reciprocally moved upon rails 38 by air cylinder 42 and to be cyclically tilted about pivot points 39 by other air cylinders 44 into position paralleling drop chutes mounted therebeneath. A set of suction cups 46 depends upon each of the carriages which cups are in fluid communication with a vacuum control mechanism. The use of multiple stacks can substantially enhance speed since they aggregiately serve to overcome speed limitations of individual blank gripping mechanisms. They also reduce the frequency of stack replenishment. If desired, other blank extracting mechanisms may be employed in practicing the invention other than that described. Exemplary of such alternatives would be those of the general types disclosed in U.S. Pat. Nos. 3,334,891; 3,204,985; 2,268,300; 2,690,337; and 2,734,744.

Figure 2:
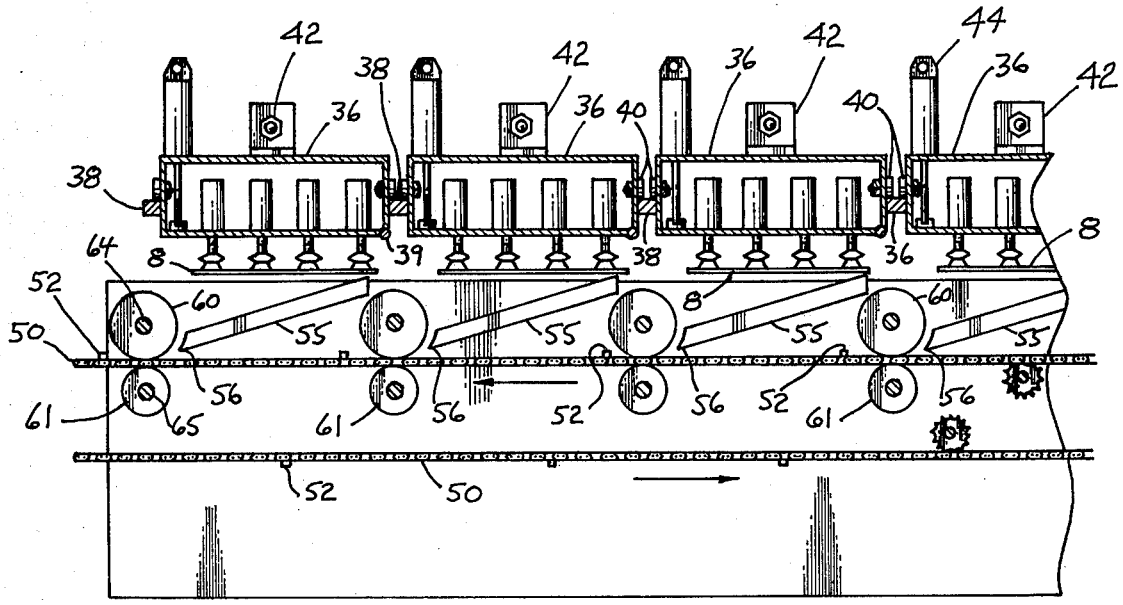
FIG. 2 is a side view, in elevation, of a feeding machine embodying principles of the present invention, which may be used in practicing methods of the present invention, shown mounted beneath a series of four blank extracting machines of the type shown in FIG. 1.

With reference next to both FIGS. 1 and 2 it will be seen that a series of four of the just described blank extracting mechanisms are mounted at a blank receiving station above a blank feeding machine having an endless conveyor 50 to which a succession of spaced lugs 52 is secured. The feeding machine also comprises a series of four inclined chutes 55 mounted above the endless conveyor belt. The chutes have lower ends or lips 56 positioned closely adjacent but in spaced relation with the conveyor 50 thereby providing a series of gaps therebetween through which lugs 52 and blanks 8 carried upon the conveyor may pass. A pair of upper feed wheels 60 and a pair of lower feed wheels 61 are mounted adjacent chute lips 56 upon shafts 64 and 65, respectively. These shafts are driven at rotary speeds such as to accelerate blanks departing chutes 55 approximately up to the speed of the conveyor as it is driven.

Figure 3:
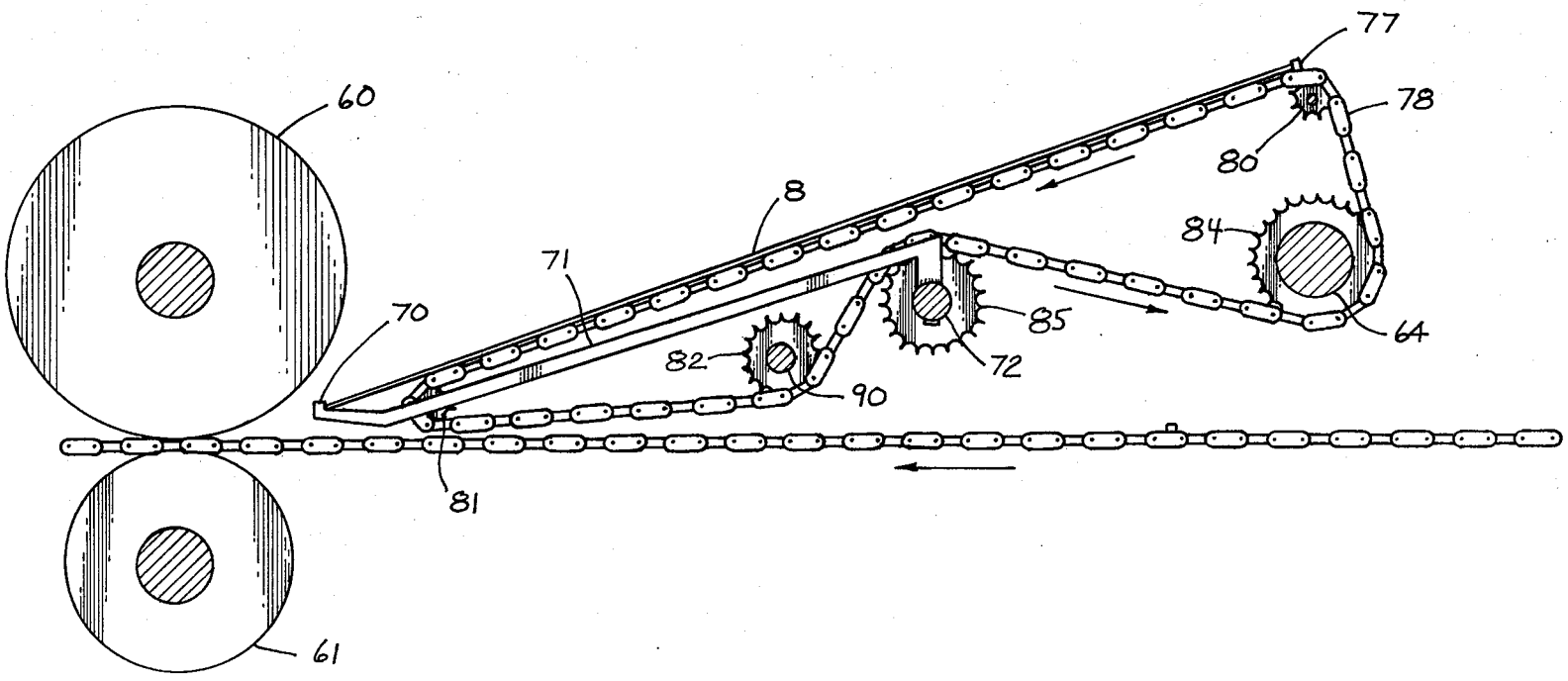
FIG. 3 is a side view, in elevation, of a portion of the machine shown in FIG. 2 illustrating mechanisms for holding and for pushing blanks down chutes.
Figure 4:
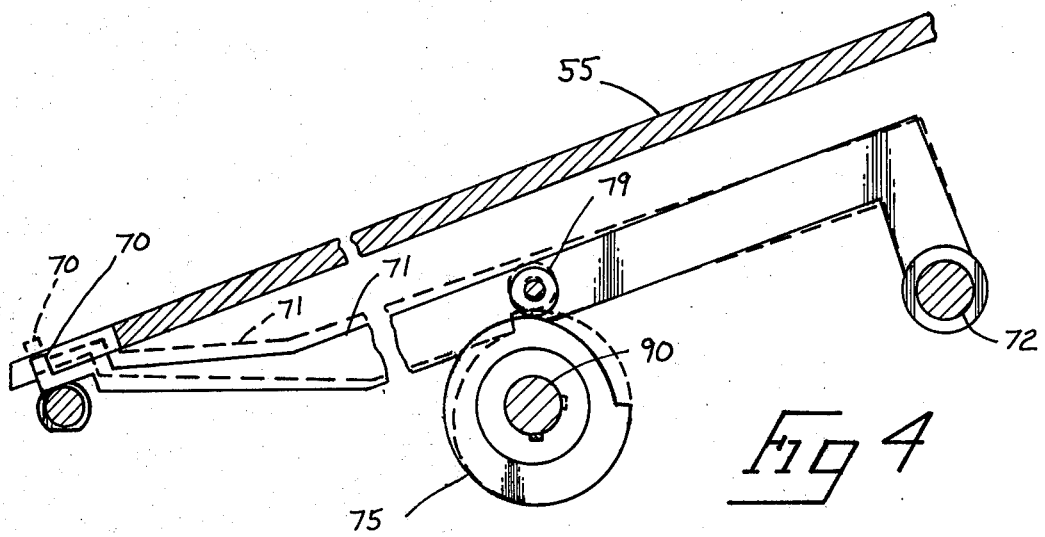
FIG. 4 is a side view, in elevation, of another portion of the machine shown in FIG. 2 illustrating a mechanism for effecting movement of the holding device shown in FIG. 3.

With reference next ot FIGS. 3 and 4 it will be seen that the blank feeding machine also has means for releasably holding blanks 8 upon chutes 55 and for positively urging them off of the chutes. The holding mechanism comprises a pair of stops 70 located is unshown slots within the chutes adjacent the chute lips. These stops are integrally formed on the end of stop levers 71 pivoted to a shaft 72. The stops are movable between positions holding blanks upon the inclined chutes and positions releasing them by means of a cam 75. The mechanisms for positively urging blanks down the chutes once they are released includes a push lug 77 mounted to an endless chain 78 which is coupled with idler sprockets 80, 81, 82, and 84, and which is driven by a drive sprocket 85 mounted to a drive shaft 72. Revolution of the drive chain 78 periodically cause lug 77 to urge blanks 8 down the chutes one at a time when stops 70 are positioned to permit such movement of the blanks down the chutes and into engagement with feed wheels 60 and 61.

Figure 5:
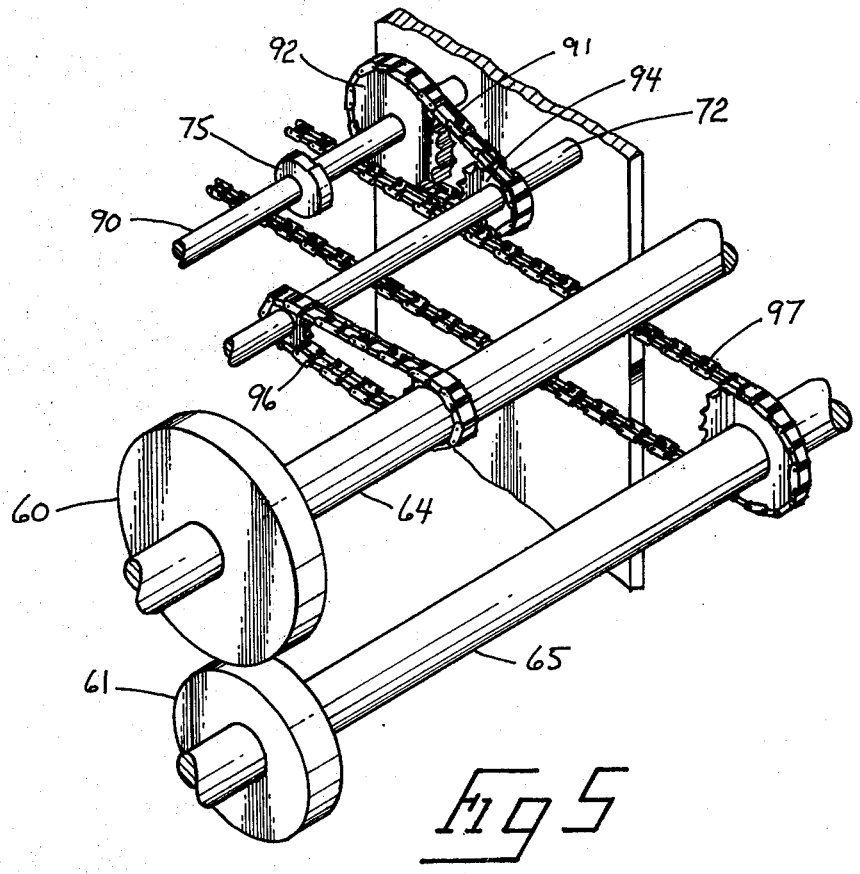
FIG. 5 is a perspective view of drive transmission means employed in operating the mechanisms shown in FIG. 4.

With reference next to FIGS. 4 and 5 it will be seen that revolution of cam 75 causes the elevation of a cam follower 79 rotatably mounted to stop lever 71 to change and, in turn, to cause stop lever 71 to move between its positions shown in solid and broken lines in FIG. 4. The cam itself is mounted to a camshaft 90 coupled by a transmission chain 91 with a sprocket 92 secured to shaft 90. Chain 91 is also coupled with a sprocket 94 mounted to the drive shaft 72 to which another endless chain 96 is coupled. Chain 96 is in turn coupled with shaft 64 to which upper feed wheel 60 is secured. Shaft 64 is coupled to shaft 65 by unshown gears to which the lower feed wheel 61 is mounted. The four individual mechanisms are coupled together as illustrated by chain 97 which couples shafts 65 of each unit together.

In operation blank stacks 10 and 11 are seated atop platforms 16 and the uppermost blank extracted by the extracting machine in FIG. 1 through reciprocation of carriages 36 upon rails 38. As they reciprocate the suction cups are also reciprocally driven downwardly into contact with the uppermost blank and suction applied thereby gripping the uppermost blank. The blank is then extracted from the top of the stack and moved to a position above chute 55 located between the pair of stacks 10 and 11 and the carriages tilted into parallel positions over the chutes. In this manner, one set of suction cups beneath one carriage can be in position to lift the uppermost blank from one stack while another blank is being positioned above the chute for release. After a blank is released another blank is extracted, the carriage moved to the other position enabling the carriage then carrying a blank to be positioned above the other stack for extraction and so forth. As the four sets of carriages mounted serially above the endless conveyor belt 50 operate they periodically drop blanks simultaneously onto the four chutes 55 located serially above the conveyor 50.

At a time when no blanks are located beneath the chutes stops 70 are cycled to release positions and push lugs 77 then moved down the chutes onto the conveyor and into gripping engagement with the feed wheels. This is done by common shaft 72 in timed relation with the position of conveyor 50 so as to drop the blanks between lugs 52 secured thereto. A set of four blanks is thus simultaneously placed upon the conveyor which is being driven at a uniform velocity $v$ so as to move the conveyor through the receiving station in time $t$ with adjacent push lugs 52 spaced apart a distance $vt/n$ where $n$ is the number of chutes at the receiving station. The set of four blanks are then urged forward as shown in FIG. 6–9 with the blanks deposited from the rearward chutes passing beneath the forward chutes without interference therewith. As soon as the last blank in that series of four leaves the forwardmost set of rollers another set of four blanks is propelled down the chutes and again onto the conveyor in timed relation with movement of the conveyor. A top to bottom sequential view of the four positions shown in FIGS. 6–9 illustrates this sequence of operation which provides for very fast and accurate feeding of stacked blanks to ancillary machinery or process line.

It should be understood that the just described embodiment merely illustrate principles of the invention in one preferred form. Many modifications, additions and deletions may, of course, be made thereto without departure from the spirit and scope of the invention as set forth in the following claims.

I claim:

1. A machine for successively feeding blanks from stacks of blanks comprising a conveyor mounted for movement along a conveyor path passing through a receiving station where blanks may be deposited thereon; a plurality of chutes mounted successively above said conveyor path at the receiving station with each chute having an exit lip positioned in spaced relation adjacent said conveyor; means for extracting blanks from the stacks and for depositing them upon said chutes; means for holding blanks deposited upon said chutes comprising stops movably mounted adjacent said chute exit lips; means for substantially simultaneously releasing blanks held on said chutes thereby enabling the blanks to be simultaneously placed upon the conveyor and successively conveyed from the receiving station which includes means for reciprocally cycling said stops between a position for holding blanks on said chutes and a position for releasing blanks from said chutes in timed sequence with movement of said conveyor through the receiving station and means for pushing blanks down said chutes in time relation with cyclic movements of said stops with said pushing means comprising an endless chain having a push lug mounted thereto coupled with and driven by said stops reciprocal cycling means.

* * * * *